US009368071B2

(12) United States Patent
Otte et al.

(10) Patent No.: US 9,368,071 B2
(45) Date of Patent: Jun. 14, 2016

(54) METHOD AND APPARATUS FOR DRIVING LIGHT EMITTING ELEMENTS FOR PROJECTION OF IMAGES

(75) Inventors: Rob Otte, Eindhoven (NL); Carsten Deppe, Aachen (DE); Oscar Jan Deurloo, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1155 days.

(21) Appl. No.: 12/602,206

(22) PCT Filed: May 30, 2008

(86) PCT No.: PCT/IB2008/052115

§ 371 (c)(1),
(2), (4) Date: Nov. 30, 2009

(87) PCT Pub. No.: WO2008/149267

PCT Pub. Date: Dec. 11, 2008

(65) Prior Publication Data

US 2010/0171771 A1 Jul. 8, 2010

(30) Foreign Application Priority Data

Jun. 6, 2007 (EP) ..... 07109678

(51) Int. Cl.
*G09G 1/00* (2006.01)
*G09G 3/34* (2006.01)

(52) U.S. Cl.
CPC ..... *G09G 3/3413* (2013.01); *G09G 2310/0235* (2013.01)

(58) Field of Classification Search
CPC ..... G09G 1/00; G09G 3/3413; G09G 3/3607; G09G 3/3426
See application file for complete search history.

(56) References Cited

U.S. PATENT DOCUMENTS

| | | | | |
|---|---|---|---|---|
| 7,740,379 | B2 * | 6/2010 | Lin et al. | 362/294 |
| 7,832,878 | B2 * | 11/2010 | Brukilacchio et al. | 353/99 |
| 7,952,112 | B2 * | 5/2011 | Wall, Jr. | 257/99 |
| 7,982,378 | B2 * | 7/2011 | Rooymans | 313/44 |
| 7,999,274 | B2 * | 8/2011 | Oh et al. | 257/96 |
| 8,107,035 | B2 * | 1/2012 | Stuart et al. | 349/64 |
| 8,128,236 | B2 * | 3/2012 | Kim et al. | 353/57 |
| 2003/0178950 | A1 | 9/2003 | Hsu | |
| 2005/0116656 | A1 * | 6/2005 | Shin | 315/169.3 |
| 2006/0023172 | A1 | 2/2006 | Ikeda et al. | |
| 2006/0038511 | A1 | 2/2006 | Tagawa | |
| 2006/0114199 | A1 * | 6/2006 | Kim | 345/77 |
| 2006/0203204 | A1 | 9/2006 | Yu | |
| 2007/0120786 | A1 * | 5/2007 | Bellls et al. | 345/84 |

* cited by examiner

*Primary Examiner* — Michael Faragalla

(57) ABSTRACT

A light source sequentially emits lights generated by at least three light emitting elements each emitting a different primary color to generate an image. Each light emitting element has a duty cycle in a lighting period, which may be an image frame period. A sequence scheme is provided for alternatingly driving different ones of the light emitting elements. The light emitting elements are driven in accordance with the sequence scheme at least two times in the lighting period, while maintaining the duty cycle for each light emitting element. In the sequence scheme, at least one light emitting element having the highest temperature sensitivity of all light emitting elements is driven more times than another one.

15 Claims, 3 Drawing Sheets

METHOD AND APPARATUS FOR DRIVING LIGHT EMITTING ELEMENTS FOR PROJECTION OF IMAGES

FIELD OF THE INVENTION

The present invention relates to a method and apparatus for projection of images by sequentially emitting lights from at least three light emitting elements each emitting a different primary color.

BACKGROUND OF THE INVENTION

An image projection apparatus uses at least three light emitting elements emitting primary colors (conventionally: red, green and blue, but not limited thereto) for displaying an image. The image may be a still image or a moving image (video) constructed of a sequence of (still) images. In order to create a video of sufficient quality for the human eye, a sequence frequency must be sufficiently high, where conventionally an image sequence rate for moving pictures of 24 Hz (film), 25 Hz (film on PAL standard, and some video), 30 Hz (film converted to NTSC standard), 50 Hz (video in PAL, often interlaced), 60 Hz (video in NTSC standard, often interlaced, frequently used in computer graphics) is used depending on the adopted standard in the relevant market. Higher frequencies are also used by some picture processing in a display device or on a computer to improve the quality of the video by enhancing the performance in moving images.

As is known from the prior art, e.g. from US 2006/0203204, according to the sequence frequency, within a time frame for constructing one image (image frame period), sequentially a red light emitting element, a green light emitting element, and a blue light emitting element are driven to illuminate a (achromatic) display panel which modulates the light for each pixel of an image to be constructed. From this publication it is further known that the light output (brightness) from a light emitting element, such as a light emitting diode (LED), may vary as a function of the temperature thereof. As a temperature of the light emitting element increases, its light output decreases. The degree of reduction of the light output depends on the type of the light emitting element, and its specific structure. It is known that in particular a red light emitting element suffers from a high temperature sensitivity, and may be the most critical color with regard to a drop of light output with increasing temperature. Green and blue light emitting elements have lower temperature sensitivities.

If no specific measures are taken, the temperature sensitivity of the light emitting elements causes the colors of an image to change over time, when the light emitting elements heat up: the light output (brightness) decreases differently for light emitting elements of different colors, and as a result a color formed by the addition of the colors generated by the different light emitting elements changes over time. This is undesirable.

According to US 2006/0203204, such problem may be solved by varying the pulse amplitude and/or the pulse width of the pulses driving the respective light emitting elements depending on the temperature of the light emitting elements such that a white balance of the generated image is retained. However, this requires a feedback control of the light emitting element driving means, and the storage of data regarding a temperature dependency of the light output of the light emitting elements. Additionally, since the maximum light output of a display device is limited by the maximum brightness of its weakest source, the control has to reduce the other colors in brightness, and overall performance is reduced.

OBJECT OF THE INVENTION

The present invention aims to provide a method and apparatus providing a simple light emitting element driving scheme resulting in a stable image color quality.

SUMMARY OF THE INVENTION

According to an embodiment of the invention, there is provided a method for driving a light source sequentially emitting lights generated by at least three light emitting elements each emitting a different primary color, in an image generating process. The light emitting elements comprise a first light emitting element, R, a second light emitting element, G, and a third light emitting element, B. Each light emitting element has a duty cycle in a lighting period, e.g. an image frame period. The method comprises: providing a sequence scheme for alternatingly driving different ones of the light emitting elements; and driving the light emitting elements according to said sequence scheme at least two times in said lighting period, while maintaining said duty cycle for each light emitting element. Here, a duty cycle is defined as a percentage indicating the ratio of a time period of applying a drive pulse, and the time period of repetition of the drive pulse. With such a driving of the light emitting elements, each light emitting element may be switched on for such a short period that it will not heat up completely during the drive pulse. The drive pulse duration is chosen small compared to the thermal time constant of the light emitting element, which reduces temperature effects on the brightness of the light emitted by the light emitting element. The fact that each light emitting element may be switched on for such a short period that it will not heat up completely during the drive pulse may also be used to allow a higher drive current without exceeding the maximum temperature of the light generating area of the light emitting element. Of course, it is also possible to save current while maintaining brightness.

According to an embodiment of the invention, in said sequence scheme, at least one light emitting element is driven more times than another one. Thus, the one or more light emitting elements that have a relatively high temperature sensitivity, such as a red light emitting element, receive a relatively high number of pulses with a relatively short duration, thereby further reducing a heating of the light emitting element while retaining an average light output.

In an embodiment of the invention, said sequence scheme comprises a sequence of driving the first, second, first and third light emitting elements, RGRB, or a cyclic transposition thereof: GRBR, RBRG or BRGR, whereby the first (e.g. red) light emitting element receives more drive pulses than the second (e.g. green) light emitting element or the third (e.g. blue) light emitting element. In another embodiment, said predetermined sequence scheme comprises a sequence of driving the first, second, first, second, first and third light emitting elements, RGRGRB, or a cyclic transposition thereof: GRGRBR, RGRBRG, GRBRGR, RBRGRG or BRGRGR, whereby the first (e.g. red) light emitting element receives more drive pulses than the second (e.g. green) light emitting element, which in turn receives more drive pulses than the third (e.g. blue) light emitting element. Still further sequence schemes may be devised containing other sequences of driving the light emitting elements, depending on the number of light emitting elements, and other considerations. For example, sequence schemes may be chosen differently between subsequent lighting periods, depending on the image to be produced.

In an embodiment of the invention, said sequence scheme is repeated n times in said lighting period, where n is an integer at least equal to 2. In an embodiment, n may be 16.

In an embodiment of the invention, the total time duration of driving one of the light emitting elements is divided evenly over the lighting period for an optimum (minimum) thermal loading of the light emitting element.

In a further embodiment of the invention, there is provided a light source device for sequentially emitting lights of different primary colors. The light source device comprises a first light emitting element, R, a second light emitting element, G, a third light emitting element, B, and a driver circuit for driving said light emitting elements with a duty cycle in a lighting period for each light emitting element. The driver circuit is configured to provide a sequence scheme for alternatingly driving different ones of the light emitting elements; and drive the light emitting elements according to said sequence scheme at least two times in said lighting period, while maintaining said duty cycle for each light emitting element.

In an embodiment of the invention, the driver circuit is configured to drive, in said sequence scheme, at least one light emitting element more times than another one.

In an embodiment of the invention, each light emitting element is a light emitting diode, LED. The light generating area of the LED is a junction contained in the LED.

It is noted that the indications R, G, B used to refer to different light emitting elements emitting different primary colors, may be taken to indicate red, green and blue primary colors, respectively, but may also be taken to indicate other primary colors. Also, more that three light emitting elements emitting primary colors may be used in embodiments of the invention.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF EXAMPLES

Figure 1:
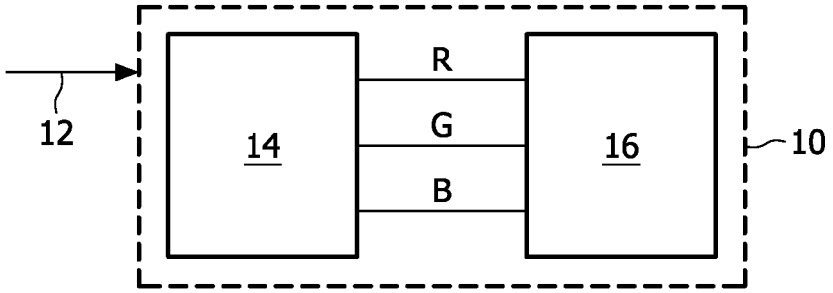
FIG. 1 schematically depicts a projection system according to an embodiment of the invention.

FIG. 1 schematically illustrates a projection system 10 using light emitting elements of different primary colors. An image data input 12 receives image data which are processed in the projection system by a driver circuit 14, which provides drive signals for different light emitting elements producing different primary colors such as red, green and blue colors for generating an image, or a sequence of images (video) in a projection apparatus 16 comprising the different light emitting elements and a display. The projection apparatus 16 may comprise one or more lenses, one or more mirrors, one or more digitally controlled micromirror devices (DMD), one or more liquid crystal devices (LCD) or thin film transistors (TFT), one or more liquid crystal on silicon devices (LcoS), and the like.

An example of such a projection system is the digital light processing (DLP®) technology by Texas Instruments.

Figure 2:
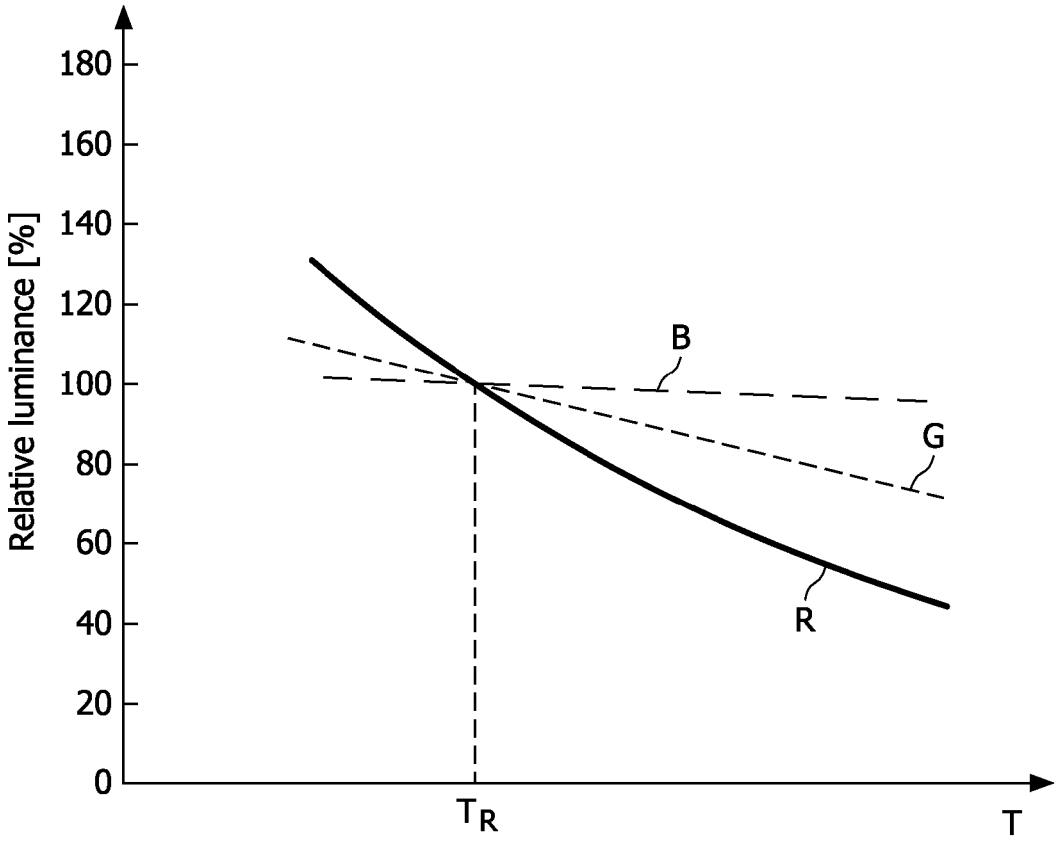
FIG. 2 depicts characteristics of a relative luminance as a function of temperature of different light emitting elements.

FIG. 2 illustrates relationships between the temperature (indicted by T) of light emitting elements emitting different colors, and a relative luminance (a light output in % of nominal value at a reference temperature $T_R$) thereof. The graphs indicated at B, G and R may be representative of blue, green and red light emitting elements, respectively. From the graphs B, G and R in FIG. 2, it appears that the relative luminance of a light emitting element, in particular a red light emitting element, may be quite sensitive to a temperature change, where a temperature increase of the light emitting element leads to a relative luminance decrease. It further appears from the graphs B, G and R in FIG. 2 that the relative luminances of light emitting elements of different colors have different temperature sensitivities, so that the same temperature change for the different light emitting elements results in an unbalance of colors of images generated by the light emitting elements.

Figure 3A:
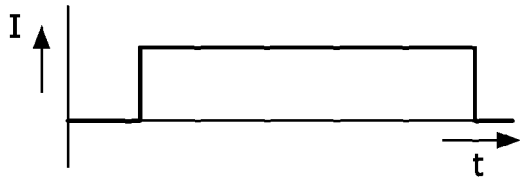
FIG. 3 depicts graphs of a current pulse and a corresponding light output pulse of a light emitting element in time.
Figure 3B:
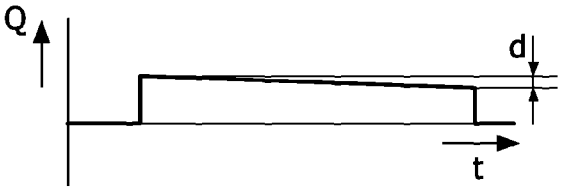

FIG. 3, at (a), depicts a time chart of a pulse of current I with a predetermined duration and amplitude, fed to a light emitting element, such as a light emitting diode (LED). As an example, the current pulse may have a duration of 1 ms, and an amplitude of 1.5 A, with a repetition frequency of 250 Hz for driving a red light emitting element. The current pulse may have other forms than the square-wave form shown in FIG. 3.

FIG. 3, at (b), depicts a time chart, associated with the time chart of FIG. 3 at (a), of the light pulse of luminous flux or radiant flux Φ (unit: lumen) produced by the light emitting element as a result of the current pulse fed to the light emitting element. It appears that the light pulse has a duration that is essentially equal to the duration of the current pulse, and an amplitude that decreases in time, as indicated by d. The reason for this decrease is the heating up of the light producing area of the light emitting element, such as a junction in an LED. This phenomenon has been discussed above with reference to FIG. 2.

Figure 4A:
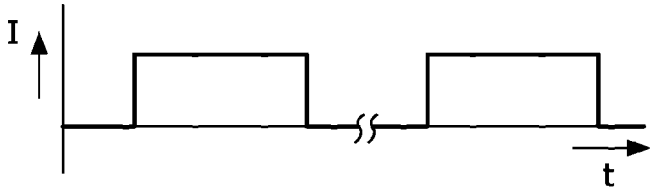
FIG. 4 depicts graphs of two current pulses and corresponding light output pulses of the light emitting element in time.
Figure 4B:
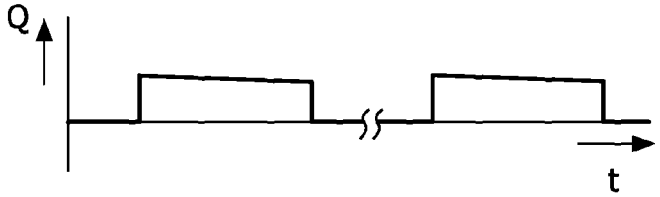

FIG. 4, at (a), depicts a time chart of pulses of current I with half the duration of the current pulse as shown in FIG. 3, the same amplitude as the current pulse as shown in FIG. 3, and twice the frequency of the current pulse as shown in FIG. 3. As an example, the current pulses may have a duration of 0.5 ms, and an amplitude of 1.5 A, with a repetition frequency of 500 Hz for driving the same emitting element as in FIG. 3. Thus, the duty cycle of the current pulses of FIG. 4 is equal to the duty cycle of the current pulses according to FIG. 3. In the case of FIG. 4, the heating of the light producing area of the light emitting element during the current pulse will be reduced, compared to the heating of the light producing area of the light emitting element during the current pulse of FIG. 3, thus resulting in less decrease of amplitude of the luminous flux or radiant flux Φ light pulse, and a higher average amplitude and duty cycle of the light pulses, as can be seen in FIG. 4, at (b).

Figure 5A:
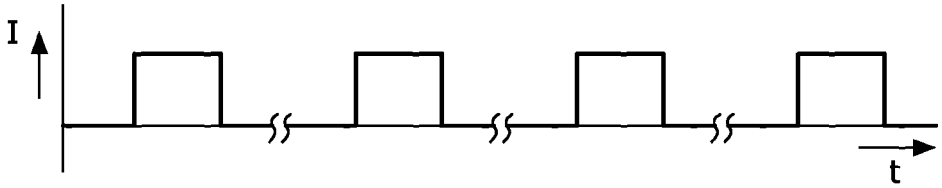
FIG. 5 depicts graphs of four current pulses and corresponding light output pulses of the light emitting element in time.
Figure 5B:
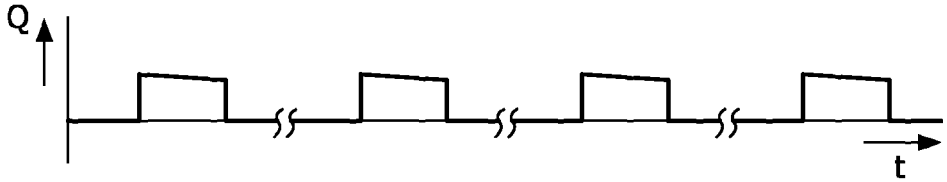

FIG. 5, at (a), depicts a time chart of pulses of current I with a quarter of the duration of the current pulse as shown in FIG. 3, the same amplitude as the current pulse as shown in FIG. 3, and four times the frequency of the current pulse as shown in FIG. 3. As an example, the current pulses may have a duration of 0.25 ms, and an amplitude of 1.5 A, with a repetition frequency of 1 kHz for driving the same emitting element as in FIG. 3. Thus, the duty cycle of the current pulses of FIG. 5 is equal to the duty cycle of the current pulses according to FIG. 3. In the case of FIG. 5, the heating of the light producing area of the light emitting element during the current pulse will be reduced, compared to the heating of the light producing area of the light emitting element during the current pulses of FIG. 3 or FIG. 4, thus resulting in less decrease of amplitude of the luminous flux or radiant flux Φ light pulse, and a higher average amplitude and duty cycle of the light pulses, as can be seen in FIG. 5, at (b).

From FIGS. 3, 4 and 5 it will be clear that the lower the current pulse duration, while maintaining a duty cycle of the current pulse sequence, the more stable the color of the (part of) an image generated by the light emitting element will be, since the temperature of the light producing area of the light emitting element can be kept more constant. Also, the average temperature is lower over an extended period of time because of the heating and cooling time constants of the typical light emitting devices.

Figure 6A:
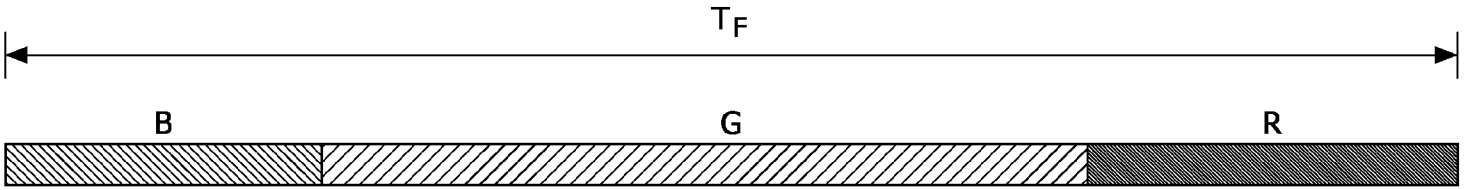
FIG. 6*a* schematically illustrates a timing of a conventional sequence of current pulses for a lighting period (e.g. an image frame period) in a projection system.

FIG. 6*a* represents an image frame time period $T_F$ used for driving three different light emitting elements in a projection apparatus, and the relative duration of driving each of the light emitting elements, as indicated by the lengths of respective subsequent sections B, G and R of the lighting (frame) time period $T_F$. For different images, the sequence scheme BGR may be repeated once per image frame period, where the duration and/or amplitude of the driving pulses for each of the light emitting elements may be varied to produce the desired color. As an example, the frame frequency may be 240 Hz.

Figure 6B:
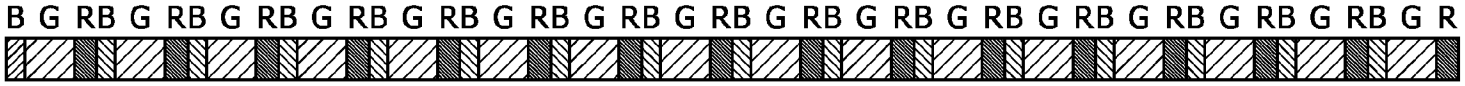
FIG. 6*b* schematically illustrates an embodiment of a timing of a sequence of current pulses according to the present invention for the lighting period (e.g. image frame period)

FIG. 6*b* represents a driving scheme of B, G and R light emitting elements, where the duty cycle of the driving of each of the different light emitting elements is equal to the duty cycle of the driving scheme according to FIG. 6*a*, however, the frequency has been increased sixteen times, so that a basic sequence scheme BGR is repeated sixteen times per image frame period $T_F$. As an example, the BGR frequency may be 3.8 kHz, with a frame frequency of 240 Hz.

Figure 6C:
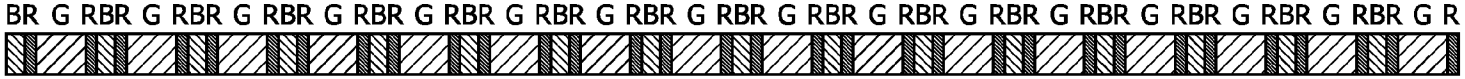
FIG. 6*c* schematically illustrates another embodiment of a timing of a sequence of current pulses according to the present invention for the lighting period (e.g. image frame period)

FIG. 6*c* represents another driving scheme of B, G and R light emitting elements, where the duty cycle of the driving of each of the different light emitting elements is equal to the duty cycle of the driving scheme according to FIG. 6*b*, however, the time duration of the R pulses has been halved, while their number has been doubled in a sequence scheme BRGR. Similar to FIG. 6*b*, the basic sequence scheme BRGR is repeated sixteen times per image frame period $T_F$. As an example, the BRGR frequency may be 3.8 kHz, with a frame frequency of 240 Hz.

Figure 6D:
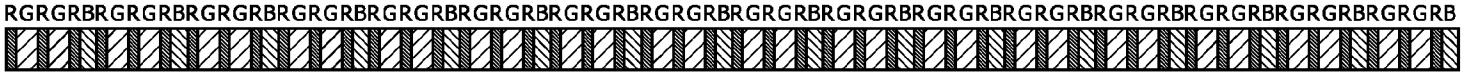
FIG. 6*d* schematically illustrates an embodiment of a timing of a sequence of current pulses according to the present invention for the lighting period (e.g. image frame period).

FIG. 6*d* represents still another driving scheme of B, G and R light emitting elements, where the duty cycle of the driving of each of the different light emitting elements is equal to the duty cycle of the driving scheme according to FIG. 6*b*, however, the time duration of the R pulses has been reduced to one third, while their number has been increased three times in a sequence scheme RGRGRB. Similar to FIG. 6*b*, the basic sequence scheme RGRGRB is repeated sixteen times per image frame period $T_F$. As an example, the RGRGRB frequency may be 3.8 kHz, with a frame frequency of 240 Hz.

In the driving schemes according to FIGS. 6*b*, 6*c* and 6*d*, an increased average light output may be obtained over the image frame period, at the same duty cycle of the light emitting drive pulses over the image frame period, and with the same amplitude of the drive pulses. A peak temperature of the light generating area of the light emitting elements, as well as an average temperature over one or more image frame periods, are reduced.

It is noted that the invention provides an additional advantage of reduction, or elimination of a color break-up phenomenon by virtue of the high drive pulse frequencies employed.

While specific embodiments of the invention have been described above, it will be appreciated that the invention may be practiced otherwise than as described. For example, at least part of the invention may take the form of a computer program in the driver circuit containing one or more sequences of machine-readable instructions describing a (part of a) method as disclosed above, or a data storage medium (e.g. semiconductor memory, magnetic or optical disk) having such a computer program stored therein. A program, computer program, or software application may include a subroutine, a function, a procedure, an object method, an object implementation, an executable application, an applet, a servlet, a source code, an object code, a shared library/dynamic load library and/or other sequence of instructions designed for execution on a computer system.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

The descriptions above are intended to be illustrative, not limiting. Thus, it will be apparent to one skilled in the art that modifications may be made to the invention as described without departing from the scope of the claims set out below.

The invention claimed is:

1. A method for driving a light source sequentially emitting lights generated by at least three light emitting elements each emitting a different primary color, the light emitting elements comprising a first light emitting element, a second light emitting element, and a third light emitting element, in an image generating process, each light emitting element having a duty cycle in a lighting period, the method comprising:

providing a sequence scheme for alternatingly driving different ones of the light emitting elements; and driving the light emitting elements according to said sequence scheme at least two times in said lighting period, while maintaining said duty cycle for each light emitting element, wherein, in said sequence scheme, the one light emitting element(s) which has the highest temperature sensitivity in all of the is driven more times than light emitting elements.

2. The method according to claim 1, wherein said the one light emitting element is a red light emitting element.

3. The method according to claim 1, wherein said sequence scheme comprises a sequence of driving the first, second, first and third light emitting elements, RGRB, or a cyclic transposition thereof.

4. The method according to claim 1, wherein said sequence scheme comprises a sequence of driving the first, second, first, second, first and third light emitting elements, RGRGRB, or a cyclic transposition thereof.

5. The method according to claim 1, wherein said sequence scheme is repeated at least twice in said lighting period.

6. The method according to claim 1, further comprising:

dividing the total time duration of driving one of the light emitting elements evenly over the lighting period.

7. The method according to claim 1, wherein the lighting period is an image frame period of a color sequentially operated display system.

8. A light source device for sequentially emitting lights of different primary colors, the light source device comprising:

a first light emitting element, R;

a second light emitting element, G;

a third light emitting element, B;

a driver circuit for driving said light emitting elements with a duty cycle in an lighting period for each light emitting element, the driver circuit being configured to:

provide a sequence scheme for alternatingly driving different ones of the light emitting elements;

drive the light emitting elements according to said sequence scheme at least two times in said lighting period, while maintaining said duty cycle for each light emitting element, drive, in said sequence scheme, one of the light emitting element more times than any other one of the light emitting elements, wherein said one of the light emitting element is the light emitting element having the highest temperature sensitivity of all light emitting elements.

9. The light source device according to claim 8, wherein each light emitting element comprises a light emitting diode, LED.

10. The light source device according to claim 8, wherein said at least one light emitting element is a red light emitting element.

11. A method for driving a light source sequentially emitting lights generated by at least three light emitting elements each emitting a different primary color, the light emitting elements comprising first, second and third light emitting elements, in an image generating process, each light emitting element having a duty cycle in a lighting period, the method comprising:

providing a sequence scheme for alternatingly driving different ones of the light emitting elements based on temperature sensitivity of the respective light emitting elements; and driving the light emitting elements according to said sequence scheme at least, two tunes in said lighting period, while maintaining said duty cycle for each light emitting element, wherein, in said sequence scheme, the first light emitting element is driven more times than the second and third light emitting elements and the second light emitting element is driven more times than the third light emitting element.

12. The method of claim 11, wherein the first, second and third light emitting elements are in order of a highest temperature sensitivity to a lowest temperature sensitivity.

13. A light source device for sequentially emitting lights of different primary colors, the light source device comprising:

a first light emitting element;

a second light emitting element;

a third light emitting element;

a driver circuit for driving said light emitting elements with a duty cycle in an lighting period for each light emitting element, the driver circuit being configured to:

provide a sequence scheme for alternatingly driving different ones of the light emitting elements based on temperature sensitivity of the respective light emitting elements;

drive the light emitting elements according to said sequence scheme at least two times in said lighting period, while maintaining said duty cycle for each light emitting element, drive, in said sequence scheme, at least one light emitting element more times than another one, wherein, in said sequence scheme, the first light emitting element is driven more times than the second and third light emitting elements and the second light emitting element is driven more times than the third light emitting element.

14. The device of claim 13, wherein the first, second and third light emitting elements are in order of a highest temperature sensitivity to a lowest temperature sensitivity.

15. The method according to claim 1, wherein, in said sequence scheme, at least one light emitting element is driven more times than another one by proportionally decreasing pulse duration and increasing pulse frequency of the at least one light emitting element.

* * * * *